US006468116B2

(12) United States Patent
Koide

(10) Patent No.: US 6,468,116 B2
(45) Date of Patent: Oct. 22, 2002

(54) TERMINAL FITTING

(75) Inventor: Takashi Koide, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/776,338

(22) Filed: Feb. 2, 2001

(65) Prior Publication Data

US 2001/0016460 A1 Aug. 23, 2001

(30) Foreign Application Priority Data

Feb. 2, 2000 (JP) ..... 2000-025482

(51) Int. Cl.[7] ..... H01R 4/18
(52) U.S. Cl. ..... 439/867; 439/877
(58) Field of Search ..... 439/865–868, 439/877, 851

(56) References Cited

U.S. PATENT DOCUMENTS 3,781,459 A 12/1973 Peek
3,989,339 A 11/1976 Haitmanek
5,561,267 A * 10/1996 Fudoo et al. ..... 439/877 X
5,635,676 A 6/1997 Piriz
6,206,727 B1 * 3/2001 Aoyama et al. ..... 439/585

FOREIGN PATENT DOCUMENTS

GB 1 435 011 5/1976
JP 4-209471 7/1992

* cited by examiner

*Primary Examiner*—Khiem Nguyen
(74) *Attorney, Agent, or Firm*—Anthony J. Casella; Gerald E. Hespos

(57) ABSTRACT

A connector is provided with crimping pieces that can be crimped into connection with a wire. The first and second crimping pieces (11, 12) are curved during crimping such that leading edges (11A, 12A) are inclined inwardly to a reduced diameter, and then are crimped into connection with a wire (W). The second crimping piece (12) is partly thinned at a position along its extending direction, to ensure that the leading edge (12A) can be bent inwardly. Thus, a crimping error resulting from such a deformation as to incline the leading edge (12A) in a direction opposite from an intended one can be prevented.

8 Claims, 13 Drawing Sheets

TERMINAL FITTING

BACKGROUND OF THE INVENTION

1. Field of the Invention

The present invention relates to a terminal fitting that can be crimped into connection with a wire.

2. Description of the Related Art

A terminal fitting that can be crimped into connection with a wire is disclosed in Japanese Unexamined Patent Publication No. 4-209471, and is identified generally by the numeral 100 in FIGS. 9 to 13 of this application. The terminal fitting 100 has a barrel-type wire-fastening portion 101 with a bottom wall 102 and first and second fastening pieces 103, 104 that extend upward from the left and right side edges of the bottom wall 102.

An automated apparatus is used to crimp the wire-fastening portion 101 into connection with a wire 105. First, as shown in FIG. 9, the wire-fastening portion 101 is placed on an anvil 106 and the wire 105 is placed between the two fastening pieces 103, 104. A crimper 107 is located above the anvil 106 and is provided with an arch-shaped guide surface 108 formed with a stepped stopper 109 substantially at the uppermost position. The crimper 107 then is lowered to crimp the fastening pieces 103, 104 to the wire 105.

During the lowering process, a leading end 103A of the first crimping piece 103 contacts the stopper 109 and is held tense, and a leading end 104A of the second crimping piece 104 contacts the leading end 103A of the first crimping piece 103 and is held tense (see FIG. 10).

Thereafter, the leading ends 103A, 104A of the first and second crimping pieces 103, 104 are bent inwardly. More particularly, the first crimping piece 103 departs from the stopper 109 and is bent along the guide surface 108 with a decreasing radius of curvature. Simultaneously, the second crimping piece 104 is bent along the inner side surface of the first crimping piece 103 with a decreasing radius of curvature. As a result, the first and second crimping pieces 103, 104 are crimped and fastened to the outer circumferential surface of the wire 105.

The crimping of the terminal fitting 100 may cause the leading end 104A of the second crimping piece 104 to be bent away from the intended bending direction, as shown in FIGS. 11 and 12, and into a reverse fold, as shown in FIG. 13. If this occurs, the folded leading end 104A may be broken along the fold and may come out through a clearance between the first crimping piece 103 and the wire 105. As a result, a clearance may be formed between the first crimping piece 103 and the wire 105, and a reduced fastening force may result.

The above-described problem is particularly prominent in terminal fittings in which a projection 110 is formed on the inner side surface of the second crimping piece 104 for strengthening a fastening force so that the projection 110 bites in the outer circumferential surface of the wire 105.

In view of the above problem, an object of the present invention is to securely crimp crimping pieces into connection with a wire.

SUMMARY OF THE INVENTION

The subject invention is directed to a terminal fitting that comprises a wire-fastening portion with a bottom wall and at least first and second crimping pieces that extend from the bottom wall. The wire-fastening portion can be crimped into connection with a wire such that the second crimping piece is deformed to reduce a radius of curvature while moving substantially along the inner side surface of the first crimping piece. Thus, the first and second crimping pieces substantially surround the outer circumferential surface of the wire.

The second crimping piece is recessed to form a deformation-facilitating portion or a weakened portion that facilitates a bending or deformation that inclines a leading end portion of the second crimping piece inwardly. Accordingly, a crimping error that deforms the leading edge in a direction opposite from an intended direction can be prevented.

Preferably, the second crimping piece is formed with a projection on the inner side surface. The projection is dimensioned and configured to bite into the outer circumferential surface of the wire. The deformation-facilitating portion preferably is formed between the projection and the leading end of the second crimping piece. Accordingly, the second crimping piece is bent between the leading edge and the projection to incline the leading edge inwardly. Angles of inclination of the bent leading end with respect to a guide surface and the first crimping piece are small as compared to a case where the second crimping piece is bent between the bottom wall and the upper projection. Thus, the second crimping piece is moved smoothly along the inner side surface of the first crimping piece to reduce a diameter.

The deformation-facilitating portion may comprise a groove that extends along at least one side surface of the second crimping piece, and preferably along the inner side surface of the second crimping piece. Additionally, the groove preferably is aligned substantially normal to the extension of the second crimping piece. Thus the groove lies substantially along a bending line, and bending can be performed more securely.

The leading end of the second crimping piece is bent about a point on the outer side surface of the second crimping piece that substantially aligns with the deformation-facilitating portion. Additionally, the groove is open in the inner side surface. Accordingly, there is no likelihood that the opening edge of the groove will be caught by the inner side surface of the first crimping piece and the guide surface while the second crimping piece is deformed to a reduced diameter during the crimping process.

The deformation-facilitating portion may be formed by thinning the second crimping piece, such as by stretching the metal plate used to produce the terminal fitting.

The bottom wall may be formed with at least one bottom projection for contacting and biting into the wire.

These and other objects, features and advantages of the present invention will become apparent upon reading of the following detailed description of preferred embodiments and accompanying drawings.

DETAILED DESCRIPTION OF THE PREFERRED EMBODIMENT

Figure 1:
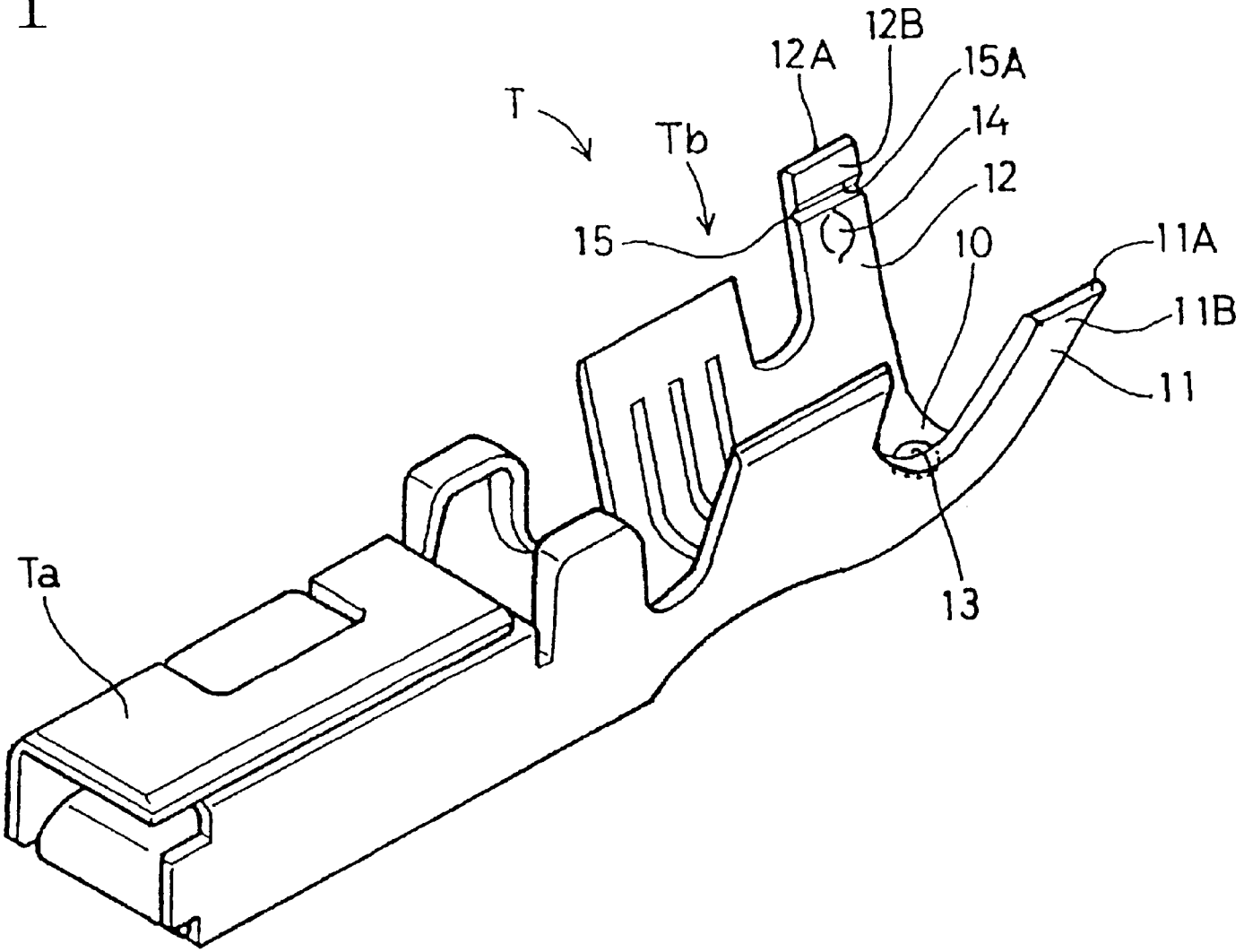
FIG. 1 is a perspective view of a first preferred embodiment of the invention.
Figure 2:
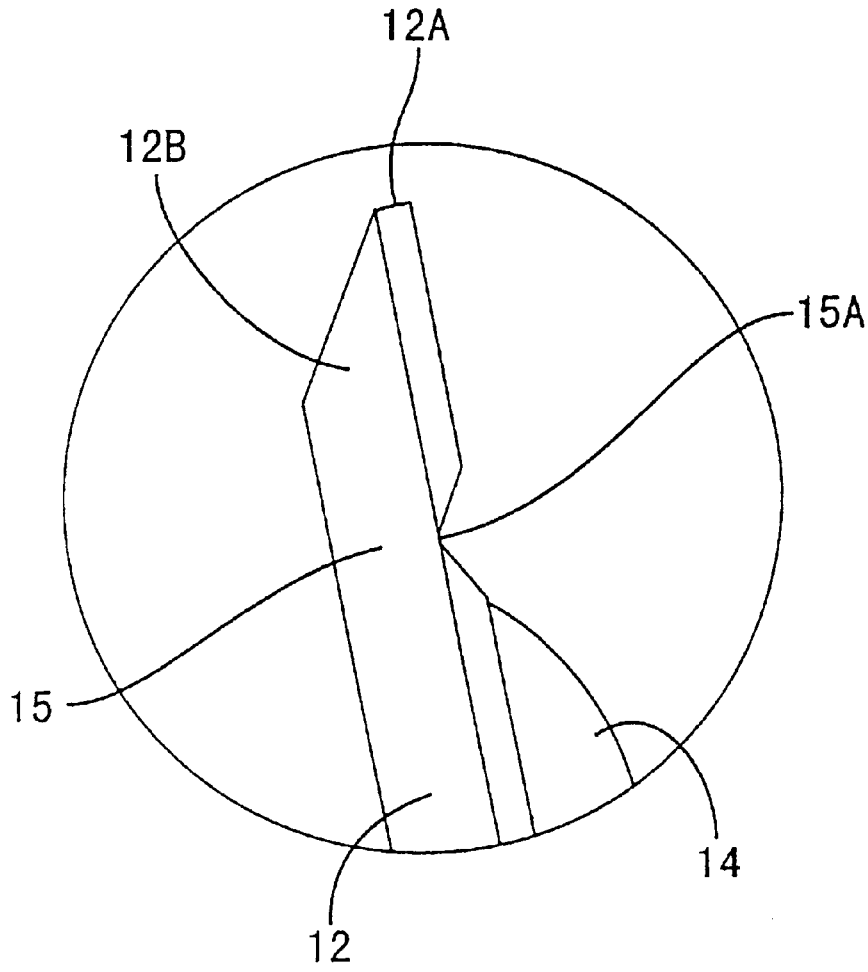
FIG. 2 is a partial enlarged front view of a second crimping piece.
Figure 3:
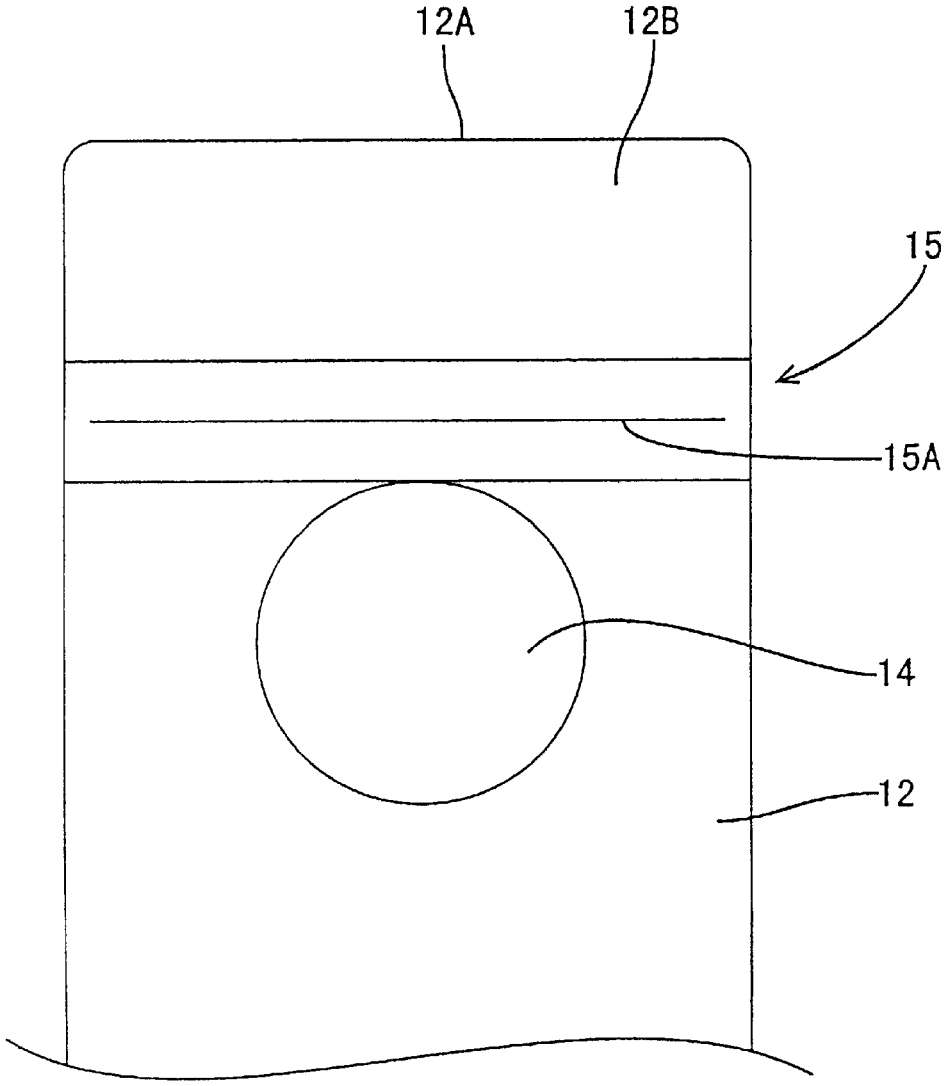
FIG. 3 is a partial enlarged side view of the second crimping piece.

A terminal fitting in accordance with the invention is identified by the letter T in FIG. 1. The terminal T has opposite front and rear ends. A connection portion Ta extends rearward from the front end and is configured for connection with a mating male terminal fitting. A wire-fastening portion Tb extends forward from the rear end and is configured for connection with a wire W.

The wire fastening portion Tb includes an arcuate bottom wall 10 that bulges out downwardly, and first and second fastening pieces 11, 12 that extend from lateral left and right side edges of the bottom wall 10. Before crimping, the two fastening pieces 11, 12 are substantially straight and diverge obliquely upward from the bottom wall 10 to define a widened spacing toward their upper ends.

The bottom wall 10 has an upward bulging lower projection 13 formed, e.g. by cutting a portion of the bottom wall 10 and bending the cut portion up or by embossing a portion of the bottom wall 10. The lower projection 13 enhances a fastening force by biting into the bottom of the outer circumferential surface of the wire W during crimping. On the other hand, an upper projection 14 is formed near the leading end of the second fastening piece and bulges inwardly or toward the first crimping piece. The upper projection 14 is formed by embossing or by a combination of cutting and bending. The upper projection 14 is disposed on the wire fastening portion Tb at a location to hold the wire W in cooperation with the lower projection 13 and preferably the upper projection 14 bites into the upper part of the outer circumferential surface of the wire W to enhance a fastening force to the wire W in cooperation with the lower projection 13.

The second crimping piece 12 is formed with a weakened deformation-facilitating portion 15 for bending the leading edge 12A inwardly toward the first crimping piece 11 during crimping. The deformation-facilitating portion 15 is formed by partly thinning or cutting the inner side surface of the second crimping piece 12 to form a straight continuous groove 15A. The groove 15A extends substantially parallel to a line along which the second crimping piece 12 is bent and hence substantially parallel to the longitudinal direction of the wire W and substantially normal to the extending direction of the second crimping piece 12 from the bottom wall 10. The outer side surface of the second crimping piece 12 is not recessed in this embodiment. The deformation-facilitating portion 15, and specifically the groove 15A, is between the leading edge 12A than the upper projection 14 and very close to the upper projection 14.

An automated crimping apparatus includes an anvil 20 and a crimper 25, as shown in FIGS. 4–7. The anvil 20 also is called a lower mold, and is formed with an arcuate placing surface 21 that has a smaller curvature (or a larger radius of curvature) than the bottom wall 10 before crimping. The bottom surface 10 of the wire-fastening portion Tb can be placed on the placing surface 21. The crimper 25 includes left and right legs 26 that project down. The crimper 25 also includes a guide surface 27 between the upper ends of the legs 26. The guide surface 27 is arch-shaped and substantially corresponds to the arcuate shape of the bottom wall 10. Opposite lateral ends of the guide surface 27 are smoothly tangentially continuous with the inner surfaces of the legs 26. A stepped stopper 28 is formed substantially at the uppermost position of the arch-shaped guide surface 27. The guide surface 27 includes a right area 27R and a left area 27L, as shown in FIGS. 4–8. The right area 27R is disposed to the right of the stopper 28 and corresponds to the first crimping piece 11. The left area 27L is disposed to the left of the stopper 28 and corresponds to the second crimping piece 12. The guide surfaces 27R and 27L extend down from the stopper 28 and diverge away from one another toward the bottom ends of the legs 26. Accordingly, the first crimping piece 11 may approach the stopper 28 while sliding on the right area 27R of the guide surface 27 during a crimping operation, but such an approaching movement is restricted by contact of the first crimping piece 11 with the stopper 28. On the other hand, the second crimping piece 12 is permitted to enter the right area 27R after passing the stopper 28 without getting caught.

Figure 4:
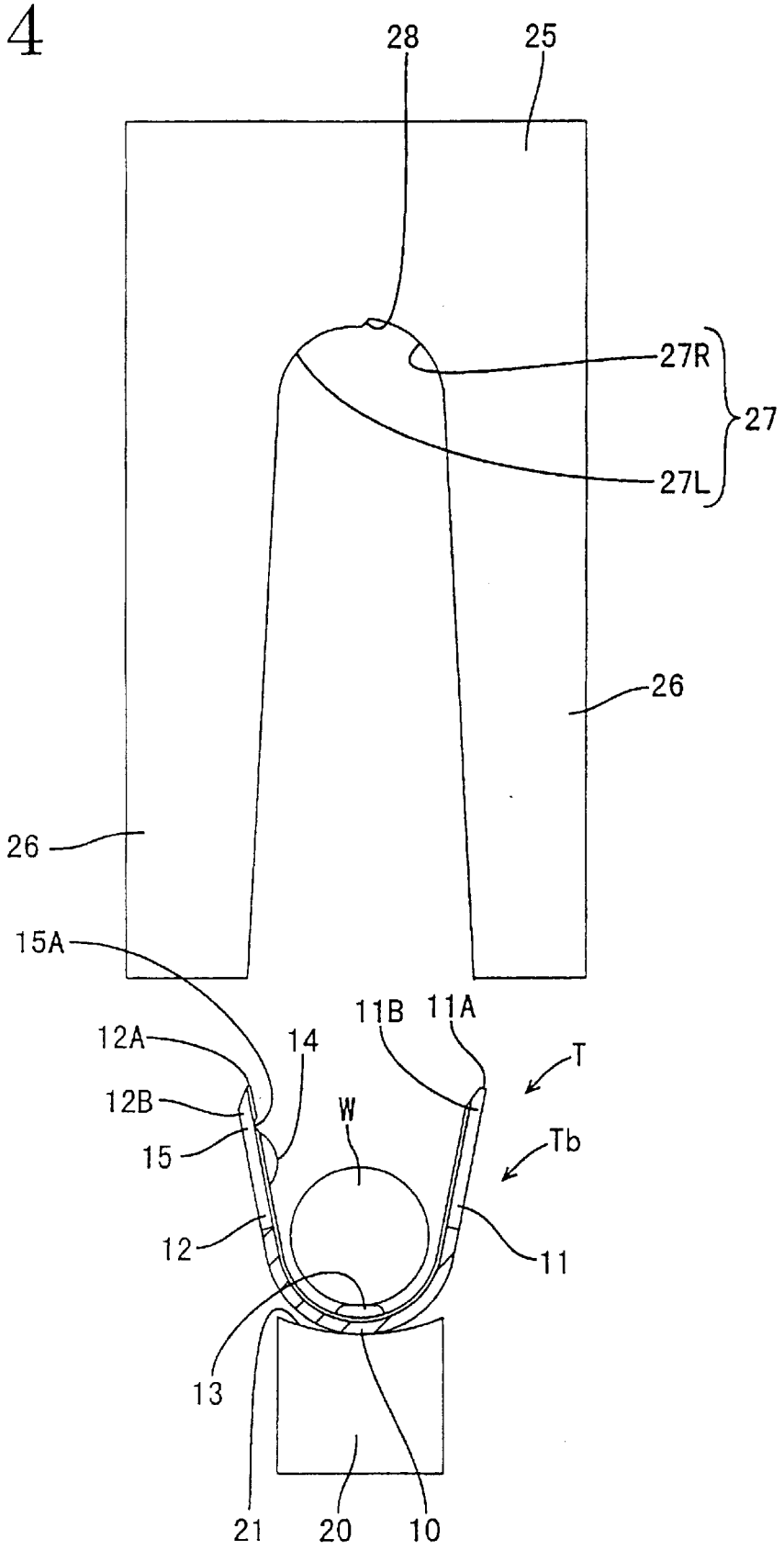
FIG. 4 is a front view showing a state before crimping.
Figure 5:
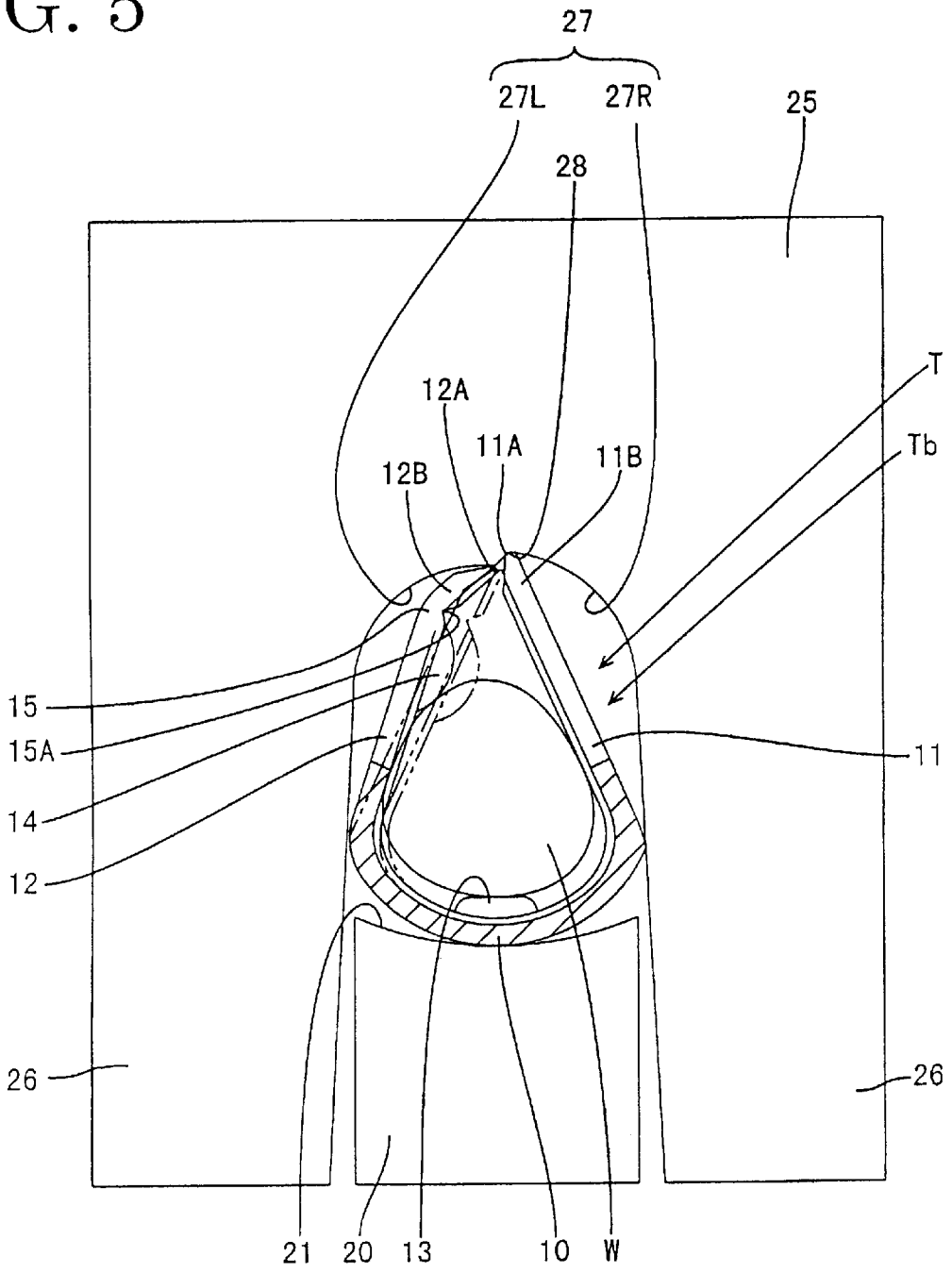
FIGS. 5 to 7 are front views showing successive states during crimping.

A crimping operation commences by initially placing the wire-fastening portion Tb on the placing surface 21 of the anvil 20, as shown in FIG. 4. The wire W then is supplied between the crimping pieces 11, 12 and on the bottom wall 10. The crimper 25 then is lowered toward the anvil 20 and brings the leading edges 11A, 12A of the crimping pieces 11, 12 into sliding contact with the inner surfaces of the legs 26. The crimping pieces 11, 12 then are displaced inwardly (directions toward the mating crimping pieces) by further sliding on the guide surface 27. Consequently, the first crimping piece 11 is held tense or chucked by contact between the leading edge 11A of the first crimping piece 11 and the stopper 28 (see FIG. 5). The second crimping piece 12, on the other hand, is held tense by contact between the leading edge 12A of the second crimping piece 12 and the inner side surface of a leading end portion 11B of the first crimping piece 11 (shown in phantom in FIG. 5). At this time, the crimping pieces 11, 12 are substantially straight without being curved or bent.

The crimper 25 is lowered further toward the anvil 20. The second crimping piece 12 is bent first such that its leading edge 12A is deformed inwardly substantially about the deformation-permitting portion 15, and at a position between the leading edge 12A and the upper projection 14, as shown in solid line in FIG. 5. At this time, the deformation-permitting portion 15 projects outward or is bent outwardly toward the side away from the first crimping piece 11 and closer to the left area 27L of the guide surface 27.

Figure 6:
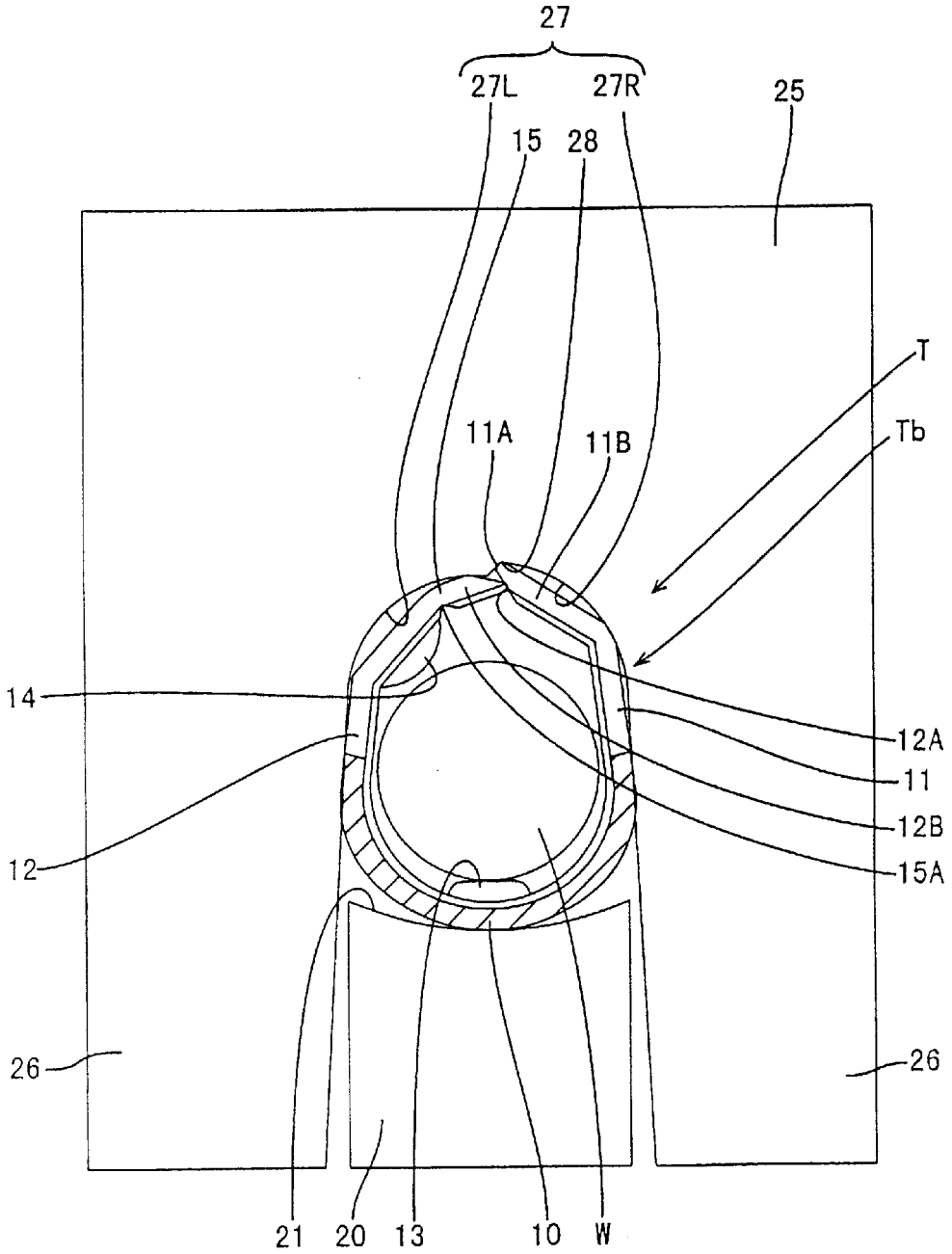

Subsequently, as shown in FIG. 6, the second crimping piece 12 is bent outwardly in a direction toward the left area 27L of the guide surface 27 at a position closer to the base end of the second crimping piece 12 than the upper projection. Thus, this second bending is at a location toward the bottom wall 10 and opposite from the leading edge 12A. The first crimping piece 11 also is bent outwardly toward the right area 27R of the guide surface 27 substantially at a center position of the first crimping piece 11 with respect to its extending direction or height direction. At this time, the bent portions of the crimping pieces 11,12 are in contact with the right and left areas 27R, 27L, respectively.

Figure 7:
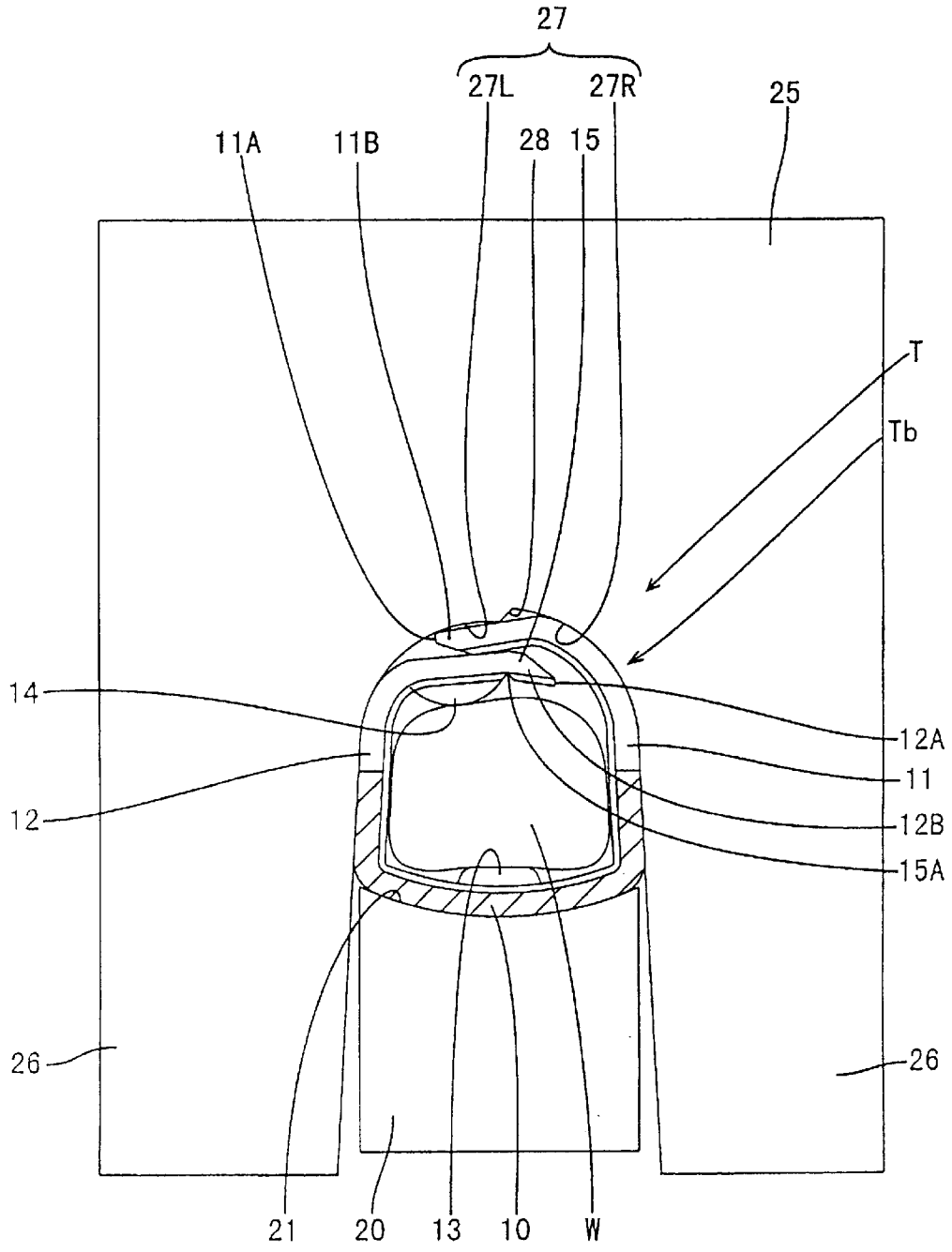

The above-described bending causes the leading end portion 11B of the first crimping piece 11 to be displaced sufficiently to extend substantially along the guide surface 27. This re-orientation causes the leading edge 11A of the first crimping piece 11 to move radially inward or toward the wire W (downward in FIG. 6) from the stopper 28. The first crimping piece 11 slides in contact with the left area 27L and slips between the guide surface 27 and the second crimping piece 12, as shown in FIG. 7. Accordingly, the first crimping piece 11 is curved along the guide surface 27 as a whole, and the radius of curvature of the second crimping piece 12 decreases.

A leading end 12B of the second crimping piece 12 between the leading edge 12A and the deformation-facilitating portion 15 is re-oriented to extend along the guide surface 27. This re-orientation causes the leading end 12B of the second crimping piece 12 to slide on the inner side surface of the first crimping piece 11 toward the bottom wall 10 and toward the side of the first crimping piece 11 opposite from its leading edge 11A. Accordingly, the entire second crimping piece 12 is curved along the inner circumferential surface of the first crimping piece 11 and the guide surface 27 to decrease the radius of curvature of the second crimping piece 12, as shown in FIG. 7.

Figure 8:
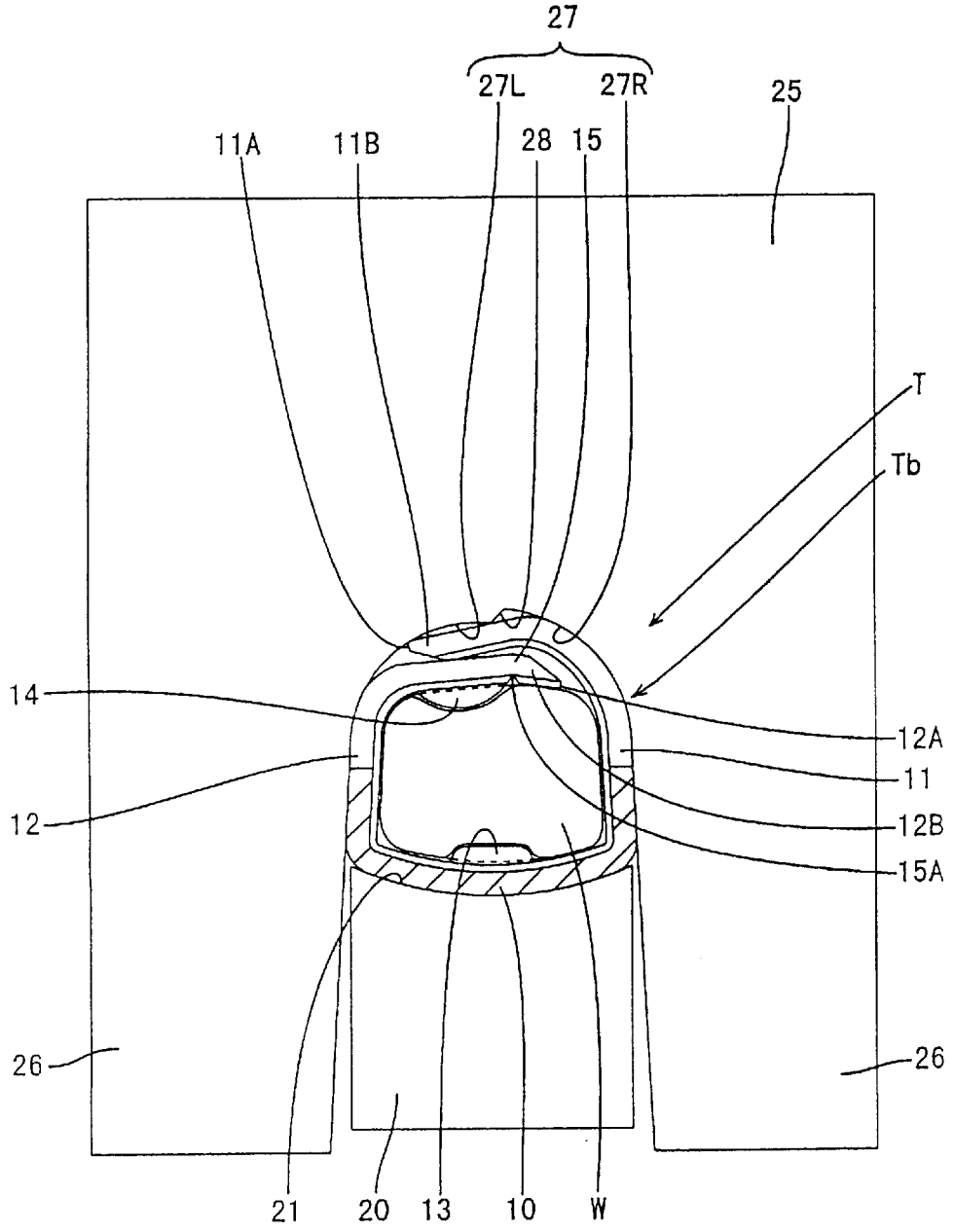
FIG. 8 is a front view showing a state after crimping.
Figure 9:
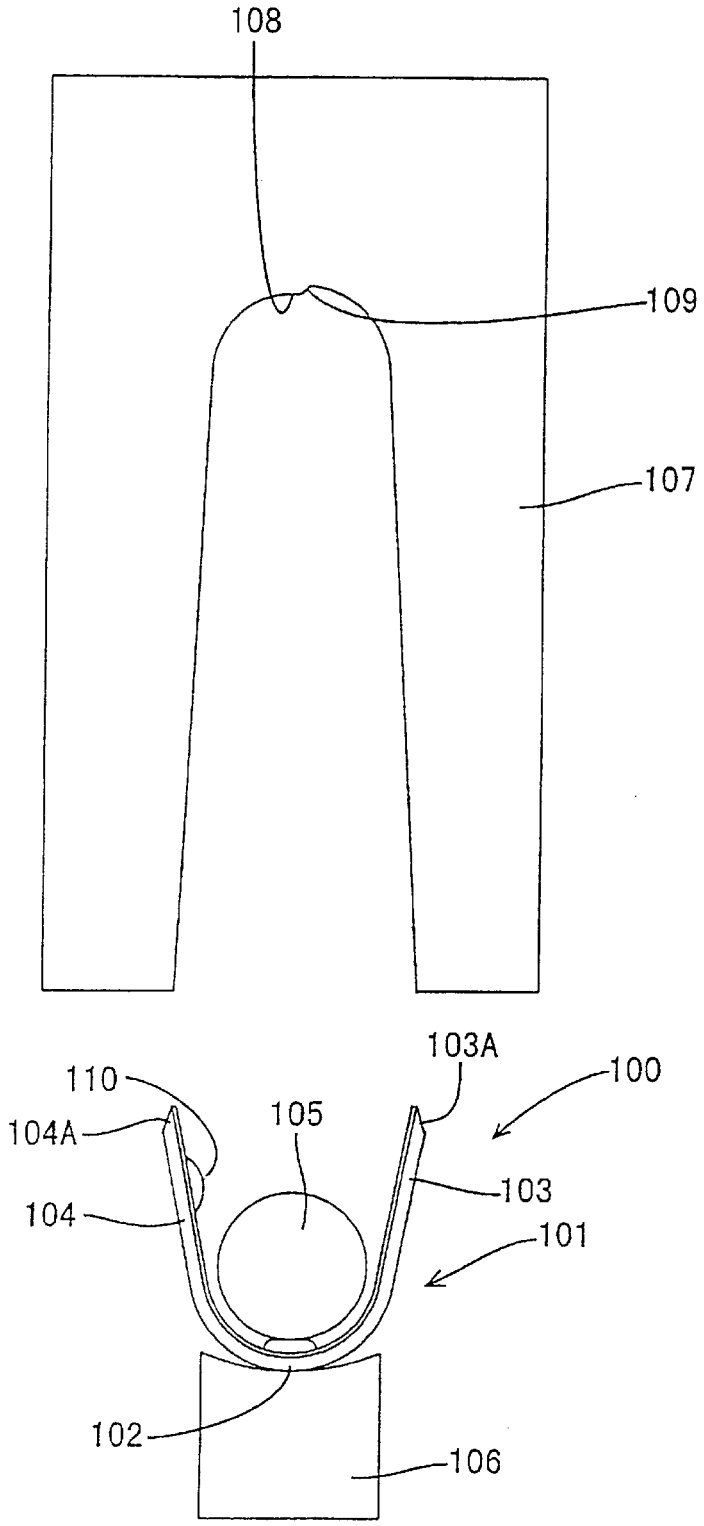
FIG. 9 PRIOR ART
FIG. 9 is a front view showing a state of a prior art before crimping.
Figure 10:
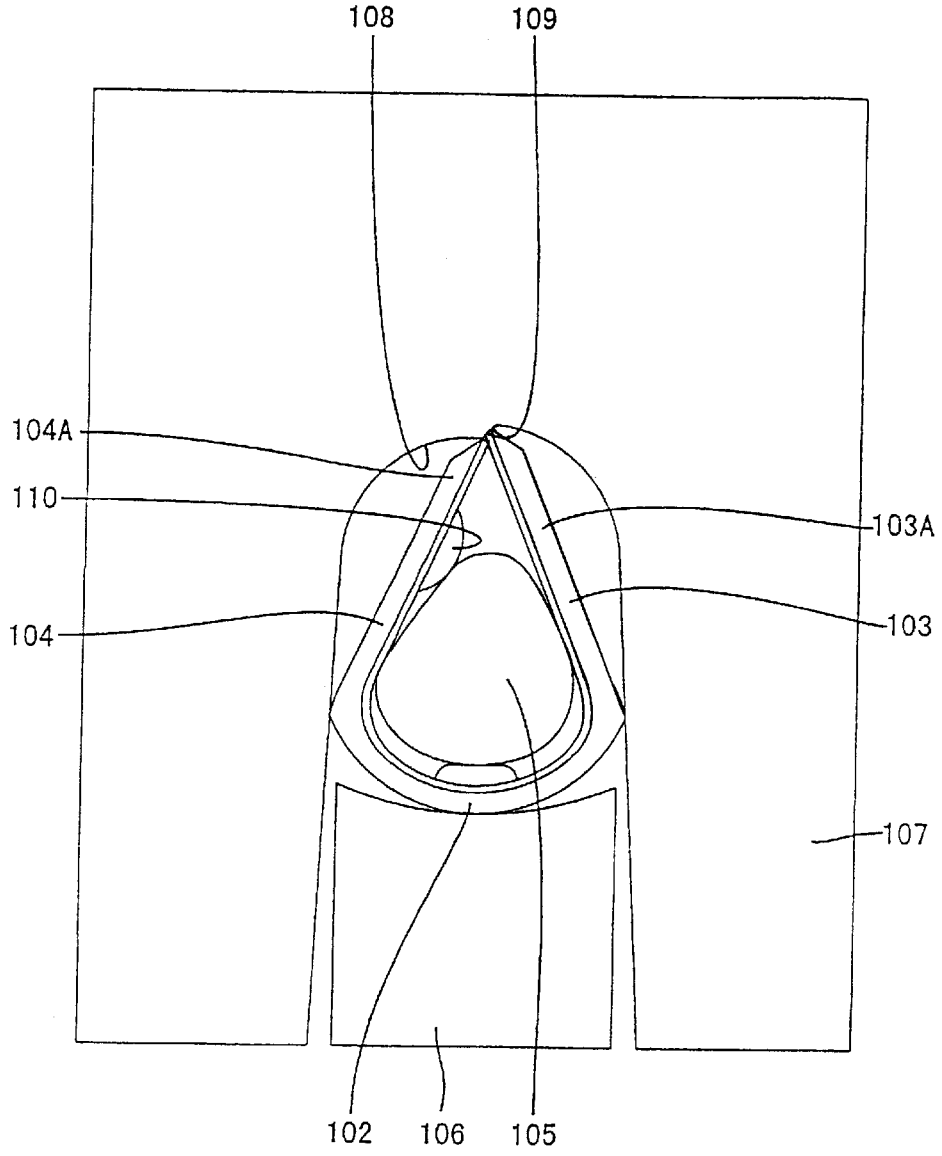
FIG. 10 PRIOR ART
FIGS. 10 to 12 are front views showing successive states of the prior art during crimping.
Figure 11:
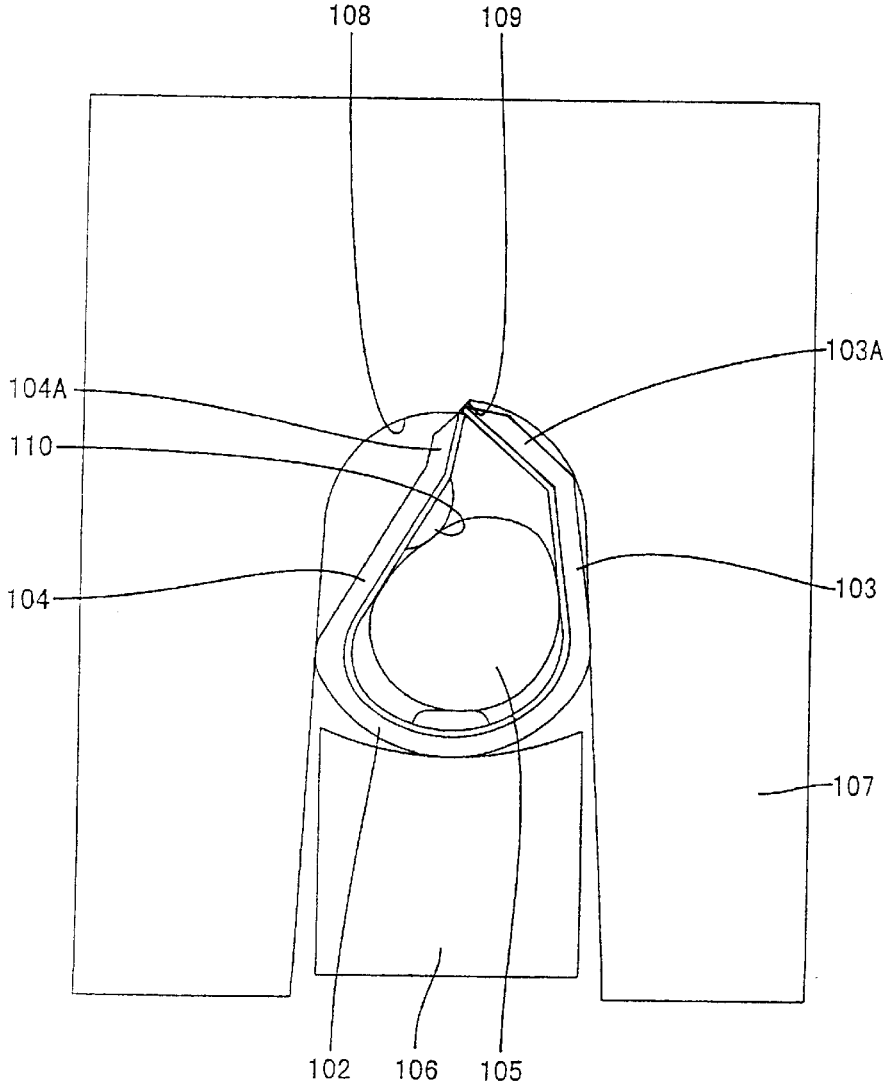
FIG. 11 PRIOR ART
Figure 12:
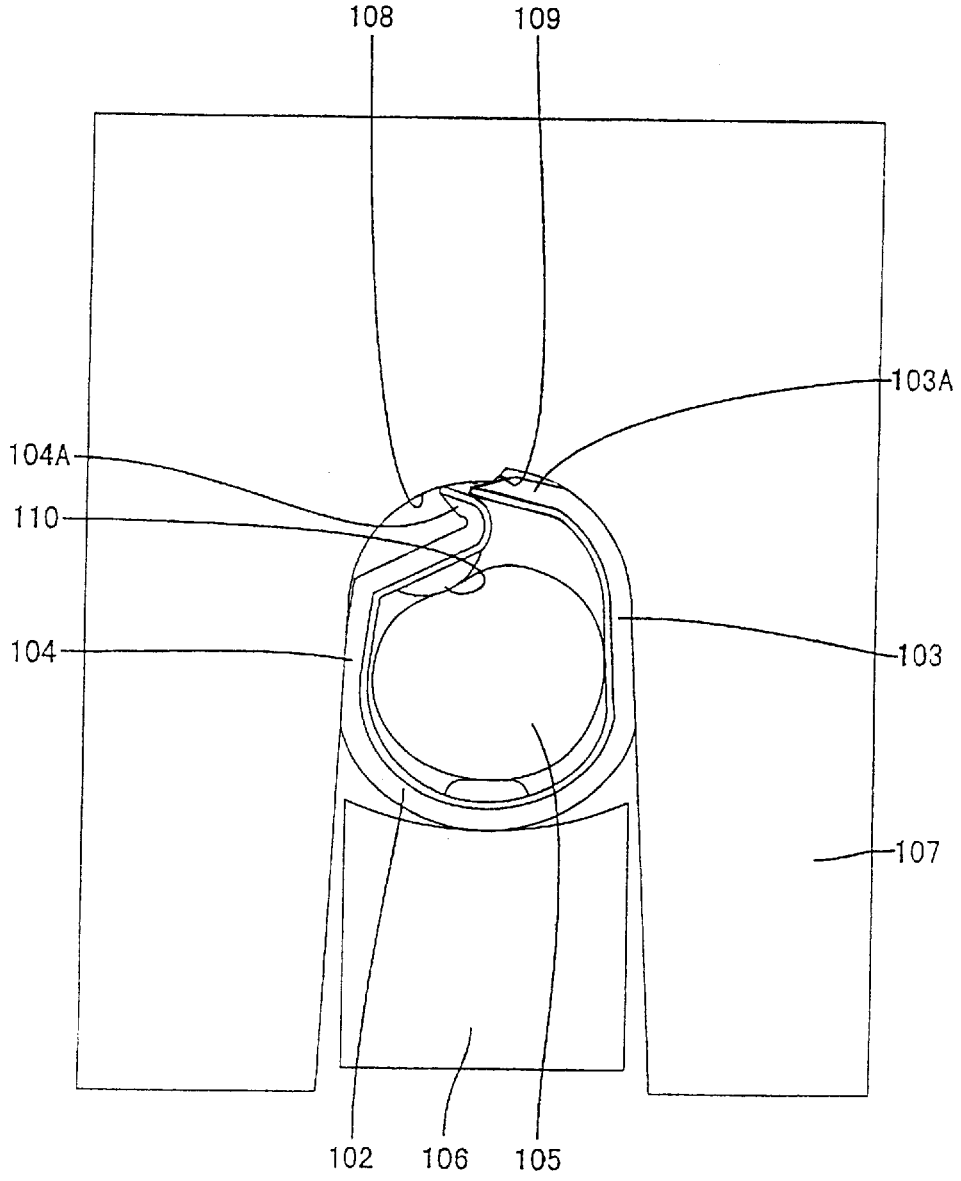
FIG. 12 PRIOR ART
Figure 13:
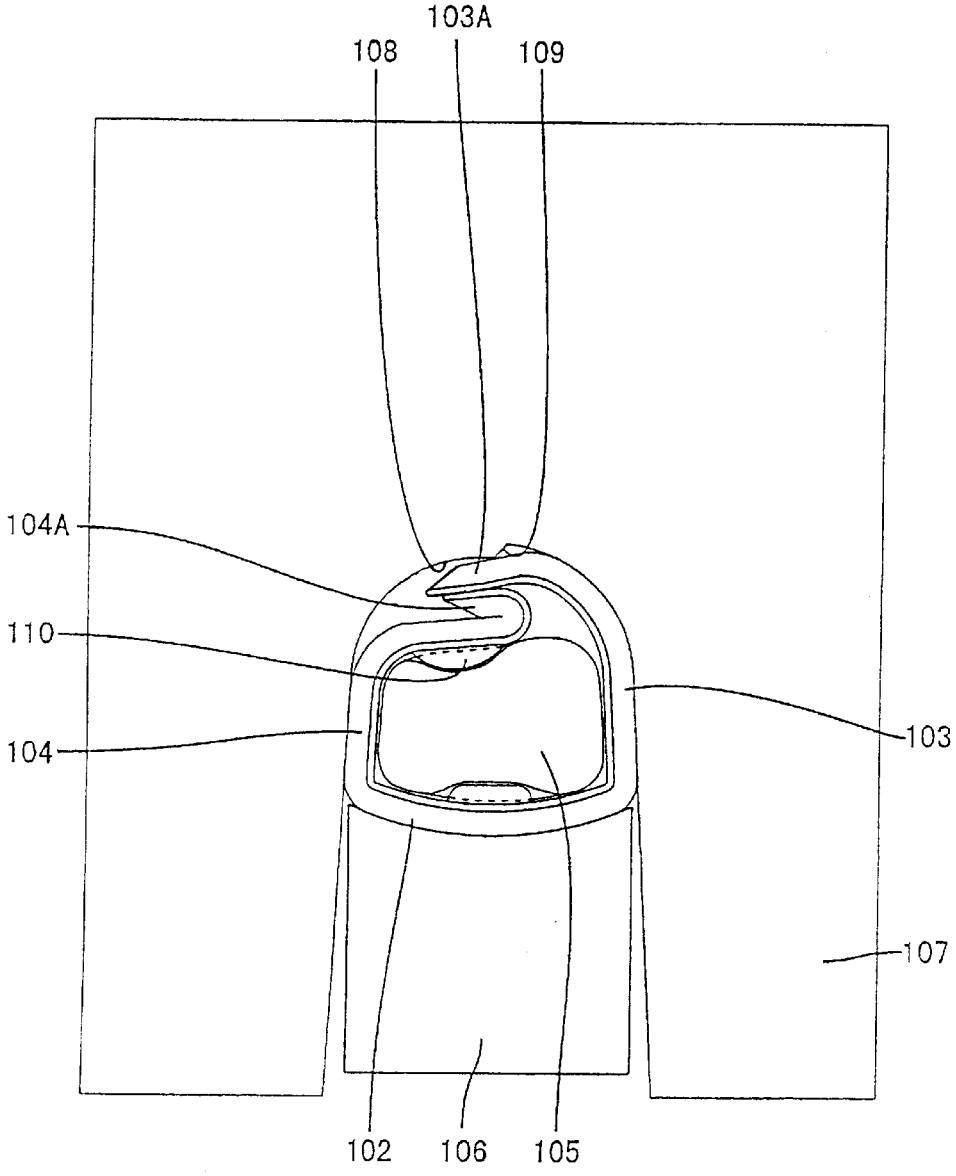
FIG. 13 PRIOR ART
FIG. 13 is a front view showing a state of the prior art after crimping.

The bottom wall 10 and the first and second crimping pieces 11, 12 are crimped and fastened to the outer circumferential surface of the wire W, and the upper and lower projections 14, 13 bite in the outer circumferential surface of the wire W. As a result, the wire fastening portion Tb of the terminal fitting T is crimped into connection with the wire W, as shown in FIG. 8.

In the embodiment described above, the second crimping piece 12 is thinned at a selected location along its extending direction to form the deformation-facilitating portion 15 and to ensure that the leading edge 12A deforms inwardly. Thus, the leading end 12B will not deform in a direction different from the intended direction and a crimping error resulting from such an unintended deformation is prevented.

The formation of the deformation-facilitating portion 15 between the leading edge 12A and the upper projection 14 brings about several advantages. Specifically, the second crimping piece 12 is bent at the deformation-facilitating portion 15 to incline the leading edge 12A inwardly. In this case, angles of inclination of the bent leading end 1 2B with respect to the guide surface 27 and the first crimping piece 11 are small, as compared to a case where the second crimping piece 12 is bent at a position between the bottom wall 10 and the upper projection 14. Thus, the leading end 12B that is bent at the deformation facilitating portion 15 is oriented more parallel to both the guide surface 27 and the leading end 116 of the first crimping piece 11 as compared to a bend formed between the bottom wall 10 and the upper projection 14. Thus, the second crimping piece 12 is moved smoothly along the inner side surface of the first crimping piece 11 to reduce a diameter after bending.

The deformation-facilitating portion 15 is a groove that extends substantially normal to the extension of the second crimping piece 12, i.e. along a bending line. Hence, bending can be performed more securely.

The deformation-facilitating portion 15 is a groove formed only in the inner side surface of the second crimping piece 12. Therefore, the leading end 12B of the second crimping piece 12 is bent at the deformation-facilitating portion 15 substantially about a point on the outer side surface of the second crimping piece 12 aligned with deformation facilitating portion 15. The positioning of the groove 15A in the inner side surface prevents the opening edge of the groove 15A from being caught by the inner side surface of the first crimping piece 11 and the guide surface 27 while the second crimping piece 12 is deformed to reduce a diameter as crimping progresses.

The present invention is not limited to the above-described and illustrated embodiment. For example, following embodiments also are embraced by the technical scope of the present invention as defined in the claims. Besides them, various changes can be made without departing from the scope and spirit of the present invention as defined in the claims.

Although a female terminal fitting is described in the foregoing embodiment, the present invention is applicable to male terminal fittings.

Although the second crimping piece is formed with the projections for strengthening the fastening force to the wire in the foregoing embodiment, the present invention is applicable to terminal fittings having no such projection.

Although the deformation-facilitating portion is a continuous recess in the form of a groove in the foregoing embodiment, it may be formed by a plurality of recesses discontinuously present substantially along a direction normal to the extension of the second crimping piece according to the present invention.

Although the deformation-facilitating portion is recessed only in the inner side surface of the second crimping piece in the foregoing embodiment, only the outer side surface of the second crimping piece may be recessed or both the inner and the outer side surfaces thereof may be recessed according to the present invention.

Although the deformation-facilitating portion is provided only in one position in the foregoing embodiment, it may be provided in a plurality of positions spaced apart along the extension of the second crimping piece.

What is claimed is:

1. A terminal fitting having a wire-fastening portion for crimped connection to a wire, the wire fastening-portion comprising a bottom wall and first and second crimping pieces that extend from the bottom wall along extending directions, the first and second crimping pieces each having a leading end spaced from the bottom wall, the first and second crimping pieces further having inner surfaces facing one another and outer surfaces facing away from one another, a projection being formed on the inner surface of the second crimping piece and a groove extending across the inner surface of the second crimping piece substantially normal to the extending direction and at a location between the projection and the leading end of the second crimping piece, the inner surface of the first crimping piece being tapered outwardly at locations adjacent the leading end of the first crimping piece and the outer surface of the second crimping piece being tapered inwardly at locations adjacent the leading end of the second crimping piece, the outward taper on the inner surface of the first crimping piece, the inward taper on the outer surface of the second crimping piece and the groove all facilitating inward bending of the second crimping piece between the leading end and the projection.

2. A terminal fitting according to claim 1, wherein the projection is configured to bite in the outer circumferential surface of the wire when the wire-fastening portion is crimped into connection with the wire.

3. A terminal fitting according to claim 1, wherein the groove is formed only on the inner side surface of the second crimping piece.

4. A terminal fitting according to claim 1, wherein the groove is formed by thinning the second crimping piece.

5. A terminal fitting according to claim 1, wherein the bottom wall is formed with at least one bottom projection for biting into the wire.

6. A terminal fitting according to claim 1, wherein the first and second crimping pieces extend substantially equal distances from the bottom wall.

7. A terminal fitting according to claim 1, wherein the projection on the inner surface of the second crimping piece abuts the groove extending across the inner surface of the second crimping piece.

8. A terminal fitting according to claim 7, wherein the taper on the outer surface of the second crimping piece extends a selected distance from the leading end of the second crimping piece, the groove on the second crimping piece being spaced from the leading end of the second crimping piece a distance greater than the selected distance for the taper.

* * * * *